US006812855B1

(12) United States Patent
Sudou et al.

(10) Patent No.: US 6,812,855 B1
(45) Date of Patent: Nov. 2, 2004

(54) ROAD TRAFFIC WEATHER OBSERVATION SYSTEM AND SELF-EMISSION ROAD SIGN SYSTEM

(75) Inventors: Terumasa Sudou, Shiga (JP); Youichirou Hishigaki, Shiga (JP); Shigeki Kondou, Shiga (JP); Motonori Ogata, Shiga (JP); Ryuji Imazu, Hokkaido (JP); Masaya Yuasa, Hokkaido (JP)

(73) Assignee: Sekisui Jushi Kabushiki Kaisha, Osaka (JP)

( * ) Notice: Subject to any disclaimer, the term of this patent is extended or adjusted under 35 U.S.C. 154(b) by 85 days.

(21) Appl. No.: 09/807,441

(22) PCT Filed: Aug. 23, 2000

(86) PCT No.: PCT/JP00/05664

§ 371 (c)(1),
(2), (4) Date: Apr. 24, 2001

(87) PCT Pub. No.: WO01/15116

PCT Pub. Date: Mar. 1, 2001

(30) Foreign Application Priority Data

Aug. 24, 1999 (JP) ..... 11-237606
Sep. 2, 1999 (JP) ..... 11-248447

(51) Int. Cl.[7] ..... G08G 1/095

(52) U.S. Cl. ..... 340/907; 340/905; 340/908; 340/539.1; 340/601; 340/602; 362/494; 362/800; 362/545; 362/490; 362/293

(58) Field of Search ..... 340/907, 905, 340/908, 539.1, 601, 602, 815.45, 815.41; 362/494, 800, 545, 490, 293

(56) References Cited

U.S. PATENT DOCUMENTS 4,298,869 A * 11/1981 Okuno ..... 340/782
4,841,278 A * 6/1989 Tezuka et al. ..... 340/908.1
5,184,114 A * 2/1993 Brown ..... 340/701
5,729,214 A * 3/1998 Moore ..... 340/905
5,771,484 A * 6/1998 Tognazzini ..... 701/117
5,848,378 A * 12/1998 Shelton et al. ..... 702/3
5,982,288 A * 11/1999 Sawatari et al. ..... 340/601
6,150,774 A * 11/2000 Mueller et al. ..... 315/291

FOREIGN PATENT DOCUMENTS

JP 9128688 5/1997

* cited by examiner

*Primary Examiner*—Daniel J. Wu
*Assistant Examiner*—Tai T. Nguyen
(74) *Attorney, Agent, or Firm*—Rader, Fishman & Grauer PLLC

(57) ABSTRACT

A self-luminous road sign system comprises a plurality of sensor units 1 . . . 1 each of which is equipped at least with a visibility meter and an illuminance meter, or which may be equipped with an anemovane and a thermometer as well as the visibility meter and the illuminance meter; and an information processing and management department 2 for centralized management of weather information detected by the plural sensor units in order to predict any danger in the road observation area, wherein the output information from the information processing and management department 2 is displayed on road installations 4 . . . 4 connected via a network. Based on the road background brightness obtained by the illuminance meter in the sensor unit, the optimum luminous brightness which provides a predetermined contrast is calculated. Based on this optimum luminous brightness and depending on the visibility information outputted from the visibility meter, the luminous brightness or information display of the sign part is controlled.

16 Claims, 12 Drawing Sheets

ROAD TRAFFIC WEATHER OBSERVATION SYSTEM AND SELF-EMISSION ROAD SIGN SYSTEM

TECHNICAL FIELD

The present invention relates to a road traffic weather-monitoring system which monitors fog rise, snowfall and other weather conditions on the road, analyzes weather conditions based on the observed data, and forecasts dangers in the driving environment, and also relates to a self-luminous road sign system which provides visual guidance and displays information to drivers.

BACKGROUND ART

In order to assist the safety of road traffic, a conventional system utilizes an ITV camera as a device for detecting road conditions, and displays a detection output from the ITV camera by means of a controller device having a display part (hereinafter mentioned as Prior Art 1). In this system, a road manager who takes charge of this controller device makes a comprehensive judgement based on the road information displayed on the display part, the road information on other areas, the weather forecast, etc. This judgement is outputted to a certain display device, which provides drivers with the road weather information or indicates safe driving signs. As the examples of conventional self-luminous road installations, use have been made of self-luminous information panels for notifying drivers of road information, LED-equipped vision guidance signs for representing a curved line shape that matches the curve on the road. The luminous part in these self-luminous road installations can be regulated at a fixed brightness, or two-stage brightness control can be applied to adjust the brightness for the day and the night, respectively.

As disclosed in Japanese Patent Application Laid-open No. H9-128688, a system for assisting safe road travel (hereinafter mentioned as Prior Art 2) comprises obstruction detecting means which includes a visibility meter and an obstruction detection radar for detecting the road driving environment, and displaying/warning means which is controlled in accordance with the output from the obstruction detecting means. These means are combined as an obstruction detecting/warning device, which is serially installed along the central reserve or a side of a road.

This system has the displaying/warning means integrated into the obstruction detecting/warning device, which is serially located along the central reserve or a side of a road. The display modes of the displaying/warning means include sound, text display, indication light (in regard to color, brightness and flash interval) and the like, and these modes can be applied singly or in combination.

As mentioned above, Prior Art 1 uses an ITV camera as the device for detecting road conditions. The ITV camera, however, is very expensive and should be mounted on a large gatepost or a giant system. Besides, in order to provide detailed information to drivers, a number of ITV cameras should be installed at required locations. Hence, it is practically impossible to place so many ITV cameras in the above manner. In another respect, since this system depends on a road manager for a comprehensive judgement, the system requires much time for such judgement and fails to give real-time information. What is worse, this self-luminous road installation is controlled to give a light at a fixed brightness. Accordingly, when visibility drops under bad weather conditions (e.g. fog, snow), the luminous brightness is seriously degraded from the viewpoint of drivers. As a consequence, the signing function as the road sign device is impaired. This problem may be solved by setting the luminous brightness of a sign, based on the low visibility situation under poor weather conditions. However, drivers find such illumination too bright in the night and feel awkward even during the day. Thus, this attempt is rather dangerous to the drivers, only to create another problem. Besides, when the level of luminous brightness is intensified, the structure consumes a greater amount of electric power and, therefore, is uneconomical.

As for Prior Art 2, the system does not rely on the centralized management by a road manager, and it assists drivers' safe driving by furnishing local or fixed individual information. In this case, it is difficult to grasp foggy, snowy or other conditions in a wide area properly, or to assist safe driving in compliance with the changing weather conditions in a particular area or the conditions across some areas. Besides, the displaying/warning means provides a single type of information merely by issuing a warning in response to obstructions on the road. More disappointingly, despite the fact that the visual perceptibility is adversely affected under a low visibility condition, the information is displayed without any consideration.

The present invention has been made for the purpose of solving these problems. The first object is to provide a road traffic weather-monitoring system which properly grasps foggy, snowy and other conditions in a wide area and which allows a road manager and others, in response to such conditions, to issue real-time weather information to drivers, thereby contributing to safe vehicle travel.

The second object is to provide a self-luminous road sign system which prevents degradation of the luminous brightness of a self-luminous road installation and improves its visual perceptibility even in a poor visibility situation, and which ensures reliable visual guidance.

DISCLOSURE OF THE INVENTION

For the purpose of achieving the above object, the structure of the road traffic weather-monitoring system according to the present invention is described with reference to FIG. 1 which is a conceptual block diagram thereof. A road traffic weather-monitoring system of the present invention comprises a plurality of sensor units 1 . . . 1, located in an observation area on a road, for detecting weather conditions in the observation area; and an information processing and management department 2 for centralized management of weather information detected by each of the sensor units 1 . . . 1, in which department analysis of the weather conditions in the observation area is made on the basis of the weather information so as to predict any danger in a driving environment.

This arrangement enables precise understanding of weather conditions (e.g. fog, snow) over a wide area, and contributes as an information source for an automatically operating, extensive road information system. As a result of centralized management of the weather conditions, actual conditions in the area can be grasped as a map, and the acquired data can be also utilized as basic data for investigation of the accident occurrence mechanism, etc.

In this arrangement, the observation area may be sectioned into a plurality of triangles, and each of the sensor units 1 . . . 1 may locate at vertices of each triangle.

This arrangement facilitates identification and prediction of the range of a foggy or snowy area, and also improves the precision of obtained weather conditions.

Preferably, each of the sensor units 1 . . . 1 is at least equipped with a visibility meter and an illuminance meter, and may be equipped with an anemovane and a thermometer as well as the visibility meter and the illuminance meter.

When each of the sensor units 1 . . . 1 are equipped with a visibility meter and an illuminance meter, the visibility meter provides visibility information such as the atmospheric particle concentration and the outdoor brightness in the road environment, while the illuminance meter gives the background brightness on the road. Additionally, the anemovane and the thermometer can furnish more detailed weather information. As a result, it is possible to grasp and predict the degree of fog rise (fog thickness, visible distance) and the snowing conditions (levels of snowing, snowstorm and visibility limitation; visible distance) in a proper and precise manner.

Further, the road traffic weather-monitoring system according to the present invention preferably includes road installations 4 . . . 4 which are connected to network communication means 3 by wire or radio communications, and which output and display, via the communication means, output information processed through the information processing and management department 2.

This arrangement contributes to safe driving by supplying drivers with proper real-time information.

The output information processed through the information processing and management department may be delivered to the Internet 5 by wire or radio communications. In this case, real-time weather information on the road environment can be easily acquired from each of terminals 6 . . . 6 connected to the Internet 5.

In addition, a self-luminous road sign system of the present invention comprises a sensor unit for detecting weather conditions, a self-luminous road installation which includes a sign part equipped with an illuminant, a control part which controls luminous brightness or information display of the sign part based on weather information detected by the sensor unit.

In the present invention, it should be understood that the sign part includes a luminous device for vision guidance (e.g. delineator), a road information panel for displaying text information or the like, and an arrow or other signs, each of which employs an illuminant as the display means.

In this arrangement, the sensor unit is equipped with a visibility meter and an illuminance meter. On the other hand, the control part is arranged to calculate an optimum luminous brightness which provides a predetermined contrast in a driving environment, based on a road background brightness that is previously obtained by the illuminance meter, and to control luminous brightness or information display of the sign part, based on the optimum luminous brightness and depending on visibility information that is outputted from the visibility meter.

This arrangement can provide drivers with information on an area where visibility is limited due to fog, snow, etc., and can advise them to drive carefully in the visibility-limited area, thereby reducing the risk of traffic accidents. Besides, within the area of limited visibility, the self-luminous road installation can notify drivers of the information, which is displayed at a properly controlled luminous brightness and in a readily recognizable display mode or sign mode. This is also contributory to safe driving.

As an additional arrangement, the sign part may be constituted with a vision guidance sign or a self-luminous information panel.

As a further arrangement, the sensor unit and the self-luminous road installation may be integrated as a road installation unit. In this case, it is preferable that the road installation unit controls, by wire or radio communications, luminous brightness or information display of the sign parts in the own road installation unit and one or more other road installations.

Furthermore, the control part may be arranged to control luminous brightness of the sign part in the self-luminous road installation to give a prescribed luminous brightness, by adjusting a pulse duration of a pulse voltage which is applied to the illuminant.

BEST MODE FOR CARRYING OUT THE INVENTION

With reference to the drawings, preferred embodiments of the present invention are hereinafter described.

<Embodiment of the Road Traffic Weather-monitoring System According to the Present Invention>

Figure 1:
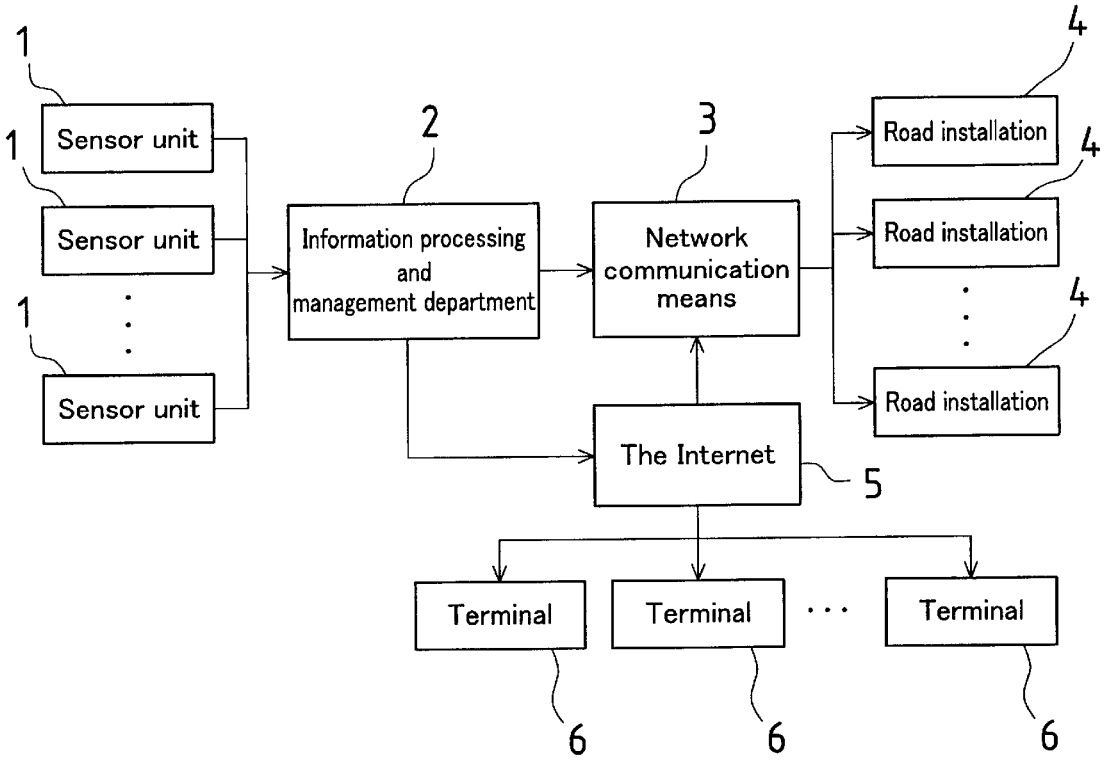
FIG. 1 is a conceptual block diagram showing the structure of the road traffic weather-monitoring system according to the present invention.
Figure 2:
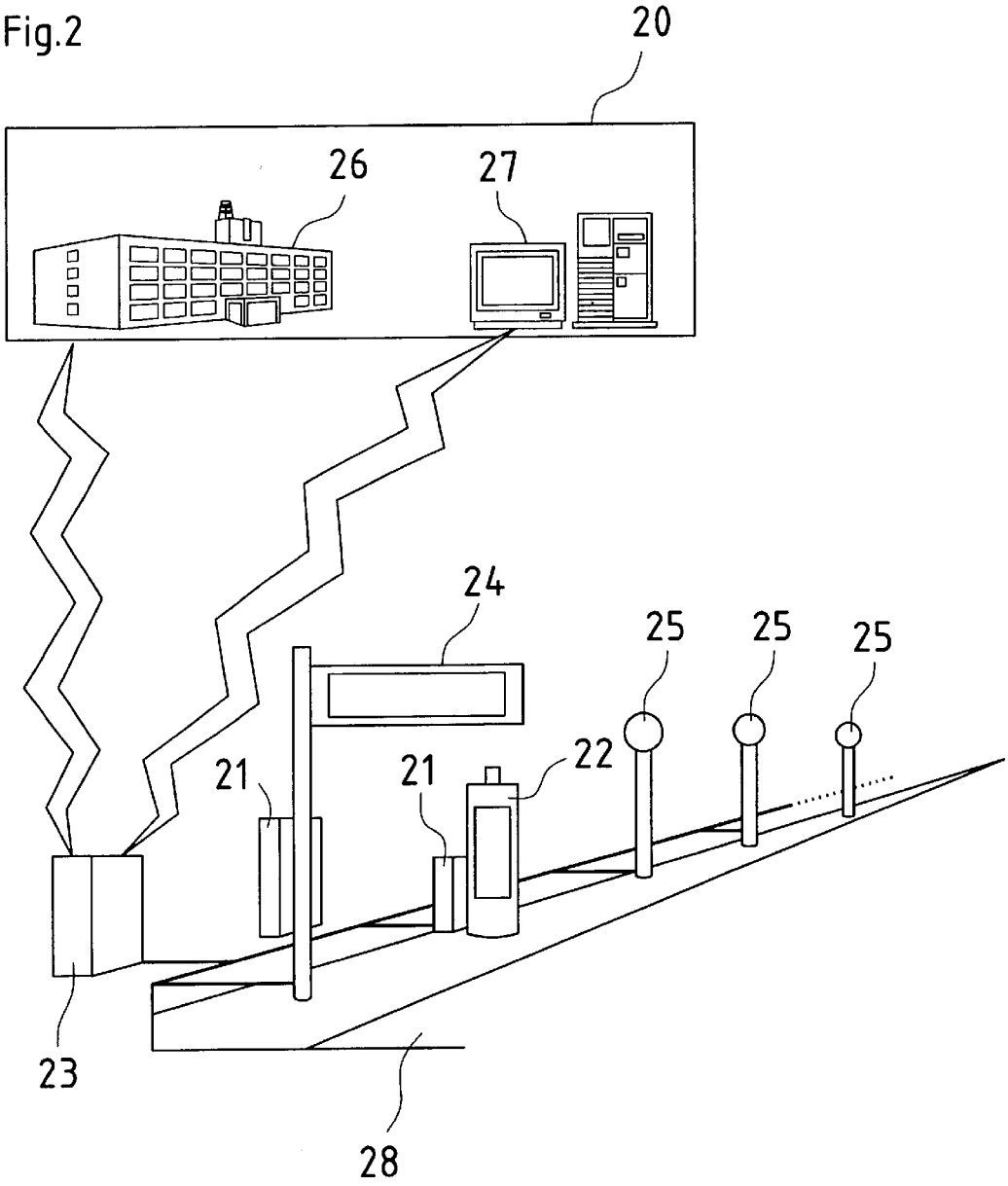
FIG. 2 is an illustrative explanation of an embodiment of the road traffic weather-monitoring system according to the present invention.

FIG. 2 is an illustrative explanation of an embodiment of the road traffic weather-monitoring system according to the present invention.

The road traffic weather-monitoring system of this embodiment comprises sensor units 22 for detecting weather conditions in an observation area on a road 28, and an information processing and management department 20 for centralized management of weather information detected by each of the sensor units 22 and in which the weather conditions in the observation area are analyzed on the basis of the weather information and any danger in the driving environment is predicted. A plurality of sensor units 22 (not shown) are located in the observation area on the road 28.

In addition, there are disposed road installations for displaying output information processed by the information processing/management department 20. Such road installations include a road information panel 24, a delineator 25 and the like. These road installations and the sensor units 22 are connected by LAN wiring, and further connected to a concentrator 23 for collecting overall information. The road information is sent via the concentrator 23 to a central server (not shown) in the information processing/management department 20 which takes charge of information management. Likewise, information from the information processing/management department 20 is delivered via the concentrator 23, and presented to drivers by means of the road installations such as the road information panel 24 and the delineator 25, or the Internet.

The information processing/management department 20 is where the weather information is grasped with the passage of time and subsequent forecasts are made. This department includes a road management department 26 where a road manager's judgement is processed, and an information processor 27 which performs predetermined data processing (described later) based on the data collected from each of the sensor units 22.

Figure 3:
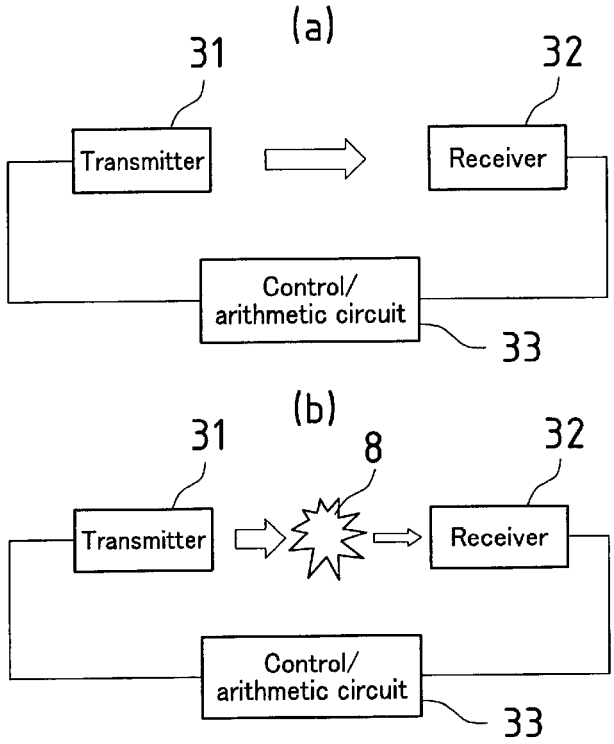
FIG. 3 is an illustrative explanation of the principle of a transmission visibility meter to be used in a sensor unit, in an embodiment of the road traffic weather-monitoring system according to the present invention.
Figure 4:
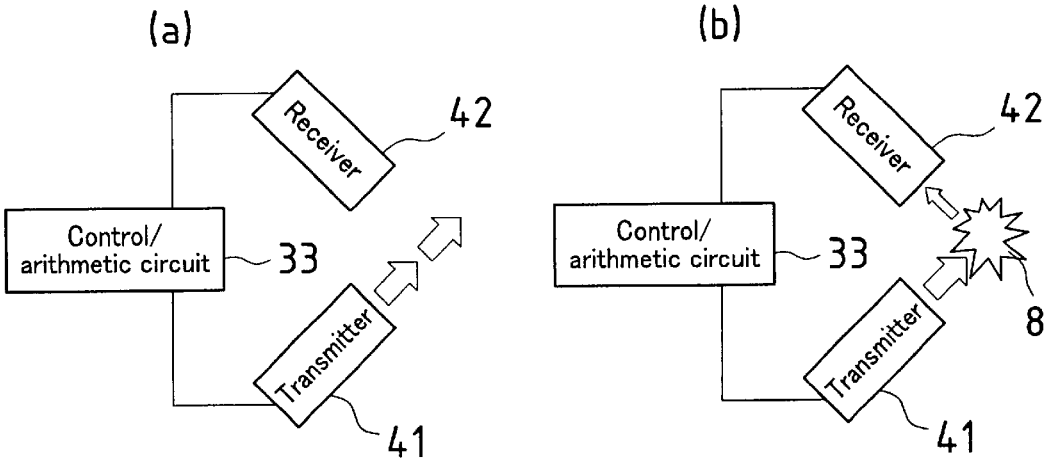
FIG. 4 is an illustrative explanation of the principle of a reflection visibility meter to be used in a sensor unit, in an embodiment of the road traffic weather-monitoring system according to the present invention.

The sensor unit 22 is constituted by a visibility meter, an illuminance meter, an anemovane, a thermometer and the like. The visibility meter is a meteorological observation instrument for measuring the concentration of atmospheric suspended matters and also for measuring the outdoor brightness, by irradiating near-infrared rays. The visibility meter used in this system includes a transmission visibility meter shown in FIG. 3 and a reflection visibility meter shown in FIG. 4. For one, the transmission visibility meter measures the concentration or transmission rate of microscopic suspended matters in the atmosphere between two points in the horizontal direction, so that the meteorological optical range (MOR) is determined based on the transmission rate. For the other, the reflection visibility meter relies on the forward scattering system that is based on scattering due to atmospheric suspended matters. It measures the concentration of microscopic suspended substances within a specified area and converts it into the MOR. Each of these visibility meters is equipped with a transmitter 31 for emitting a near-infrared ray, a receiver 32 for receiving the near-infrared ray and a control/arithmetic circuit 33 for computing the variation of the quantities of light received by the receiver 32 and calculating the MOR. The transmission visibility meter works according to the following principle. Referring to FIG. 3(*a*), where there is no suspended substance 8, the near-infrared ray projected from the transmitter 31 is received 100% by the receiver 32. On the other hand, referring to FIG. 3(*b*), in the presence of suspended substances 8, the near-infrared ray is scattered by the suspended substances 8, so that the light to be received by the receiver 32 is attenuated and decreased in quantity. As for the principle of the reflection visibility meter, referring to FIG. 4(*a*), where there is no suspended substance 8, the near-infrared ray projected from the transmitter 31 is not received by the receiver 32, which means that the light quantity is zero. Referring then to FIG. 4(*b*), in the presence of suspended substances 8, the near-infrared ray is scattered by the suspended substances 8. In this case, the near-infrared ray from the transmitter 31 is partly received by the receiver 32, which results in the increase of the light quantity.

The visibility meters of these structures play an important part as a sensor. Their detection data is utilized to control the display or the sign output for each road installation such as the road information panel 24 and the delineator 25, whereby the goal of safe driving is achieved. This visibility meter is utilized in combination with an illuminance meter. The illuminance meter measures the illuminance in the foggy, snowy and other driving environments, throughout the day and the night. Based on the data measured by the illuminance meter, the luminous brightness of an illuminant, particularly the one which constitutes the display or the sign part of the self-luminous road installation, is automatically controlled to establish a proper contrast for driver's eyes.

Figure 5:
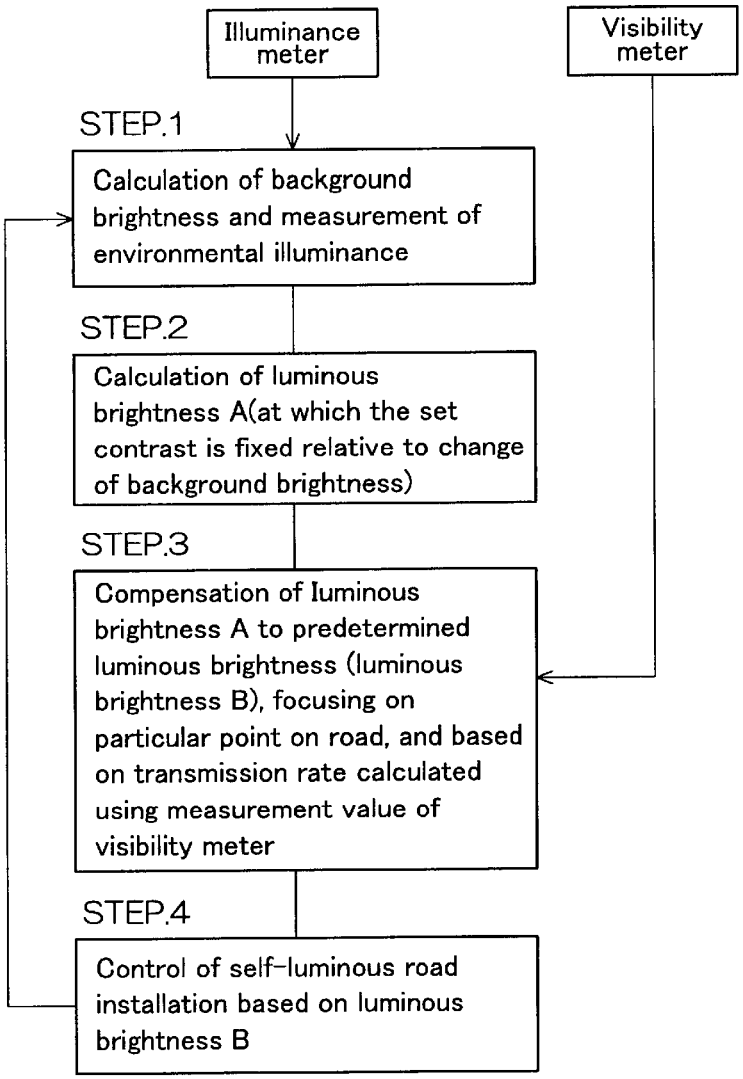
FIG. 5 is an explanatory diagram of a method for automatically controlling the luminous brightness of the self-luminous road installation, in the embodiments of both the road traffic weather-monitoring system and the self-luminous road sign system according to the present invention.
Figure 6:
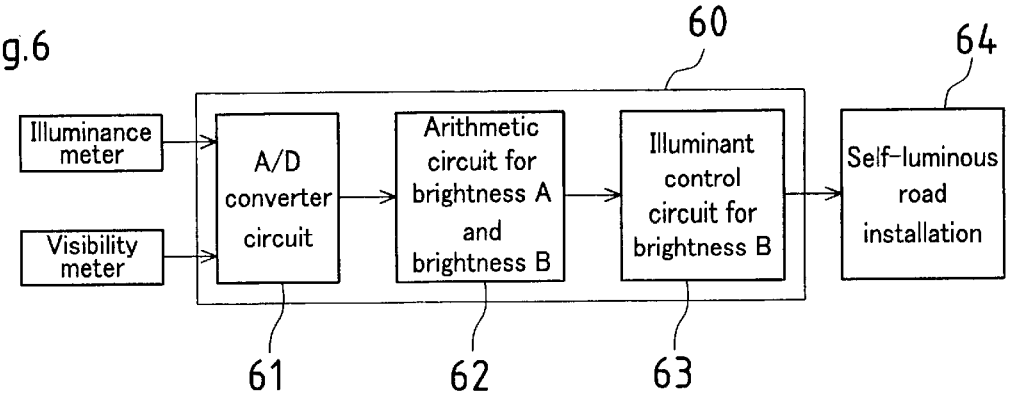
FIG. 6 is an explanatory block diagram of a method for automatically controlling the luminous brightness of the self-luminous road installation, in the embodiments of both the road traffic weather-monitoring system and the self-luminous road sign system according to the present invention.

Now turning to FIG. 5 and FIG. 6, description is made on the method for automatically controlling the luminous brightness of an illuminant in the self-luminous road installation, with the use of the visibility meter and the illuminance meter.

FIG. 5 is an explanatory diagram of a method for automatically controlling the luminous brightness of the self-luminous road installation to be applied to the embodiment of the present invention.

FIG. 6 is an explanatory block diagram of the self-luminous road installation to be applied to the embodiment of the present invention.

First of all, the background brightness should be preset relative to the illuminance. The background brightness, which means a reflective brightness of the sunlight, is set to the reflective brightness of snowy white, as an example. Meanwhile, the environmental illuminance is calculated according to the data measured by the illuminance meter (STEP.1). The contrast is represented as the difference or ratio of the luminous brightness of the illuminant relative to the background brightness, or as the ratio of their difference relative to the background brightness. Using this contrast, calculation is made to obtain a luminous brightness A which is fixed against the change of the background brightness (STEP.2). Then, focusing on a particular point where driver's visual recognition is desired (e.g. 50 meters in front of the self-luminous road installation), the luminous brightness A is compensated to a predetermined luminous brightness, based on the transmission rate which is calculated using the measurement value of the visibility meter at the particular point (STEP.3). With respect to the illuminant in the self-luminous road installation, the drive of the illuminant is controlled in such a manner as to bring its luminous brightness equal to the compensated luminous brightness (luminous brightness B) (STEP.4).

This method is embodied by an optimum brightness calculation circuit 60 shown in FIG. 6. The optimum brightness calculation circuit 60 comprises an A/D converter circuit 61 which converts, from analog to digital, the data measured by the illuminance meter and the visibility meter, an arithmetic circuit 62 which calculates the luminous brightness A and the luminous brightness B as mentioned above, an illuminant control circuit 63 which controls the luminous brightness of the illuminant in the self-luminous road installation 64 to the luminous brightness B.

Further, the sensor unit 22 includes an anemovane for measuring the wind direction and the wind speed, and a thermometer. Their data are accumulated to the weather data as well.

In addition, the sensor unit 22 is equipped with a controller 21 which establishes communication with the information processing/management department 20 via the concentrator 23. The controller 21 contains a communication circuit and realizes a wired or radio communication line.

As heretofore described, the sensor unit 22 can produce various measurement data on the ever-changing weather conditions. The measured data is supplied to the information processing/management department 20 as the weather data.

The road installations for accomplishing safe driving include the road information panel 24, the delineator 25 and the like, as already mentioned. The road information panel 24 is a multi-functional information panel which displays a prearranged text information depending on the driving environment on the road 28, and also displays other information that should be displayed in view of the above-mentioned weather data. Such a multi-functional information panel is capable of displaying both information alternately and providing a greater volume of information. As mentioned above, lighting on the display part is automatically adjusted in accordance with the MOR and the illuminance which are obtained by the visibility meter and the illuminance meter, respectively, and thus automatically controlled to provide a suitable contrast to driver's eyes depending on the weather conditions on the road 28.

The delineator 25, which provides visual guidance, is a self-luminous element. Similar to the above description, lighting on the delineator 25 is automatically adjusted in accordance with the MOR and brightness obtained, and automatically controlled to provide a suitable contrast to driver's eyes depending on the weather conditions on the road 28.

For the road installations, this system can also employ an arrow sign, a fletching sign and the like (not shown), in addition to the road information panel 24 and the delineator 25 mentioned above.

The concentrator 23 transmits the operational conditions of these installations in the driving environment on the road 28, via communication means using TCP/IP (Transmission Control Protocol/Internet Protocol), to the central server in the information processing/management department 20 where comprehensive information management is conducted. The information to be managed includes operational information on the installations (brightness, displayed characters, operational condition), meteorological measurement data (visible distance, illuminance, wind direction/wind speed, temperature) and digital moving pictures.

Figure 7:
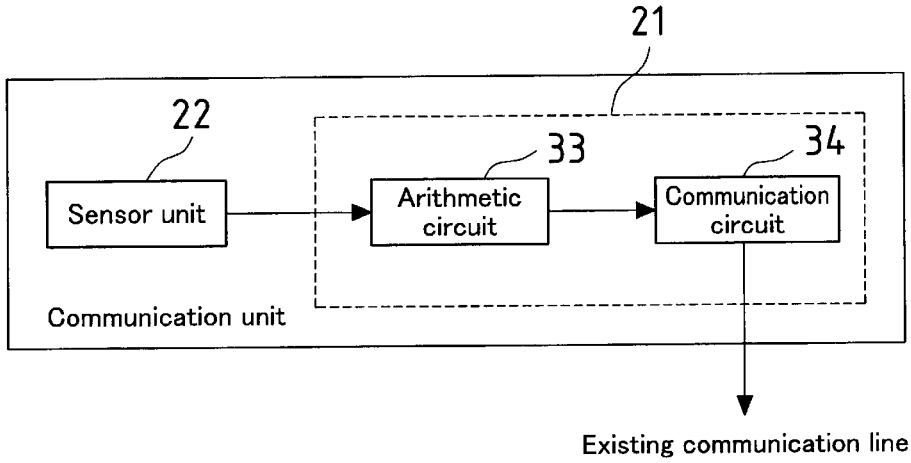
FIG. 7 is an explanatory block diagram of a controller which is related to the sensor unit in an embodiment of the road traffic weather-monitoring system according to the present invention.

FIG. 7 is an explanatory block diagram of a controller which is related to the sensor unit in an embodiment of the road traffic weather-monitoring system according to the present invention.

The controller 21 is disposed in the vicinity of, or integrated with, the sensor unit 22. The controller 21 comprises an arithmetic circuit 33 which calculates the MOR and the like based on the visibility data acquired by the sensor unit 22, and a communication circuit 34 through which the measurement data (e.g. visibility data) and the weather data obtained by the sensor unit 22 plus the output information from the arithmetic circuit 33 are supplied to the information processing department 20 via a communication line. In addition, the controller 21, located near the road information panel 24 or integrated therewith, provides the output information from the information processing department 20 to each road installation.

Figure 8:
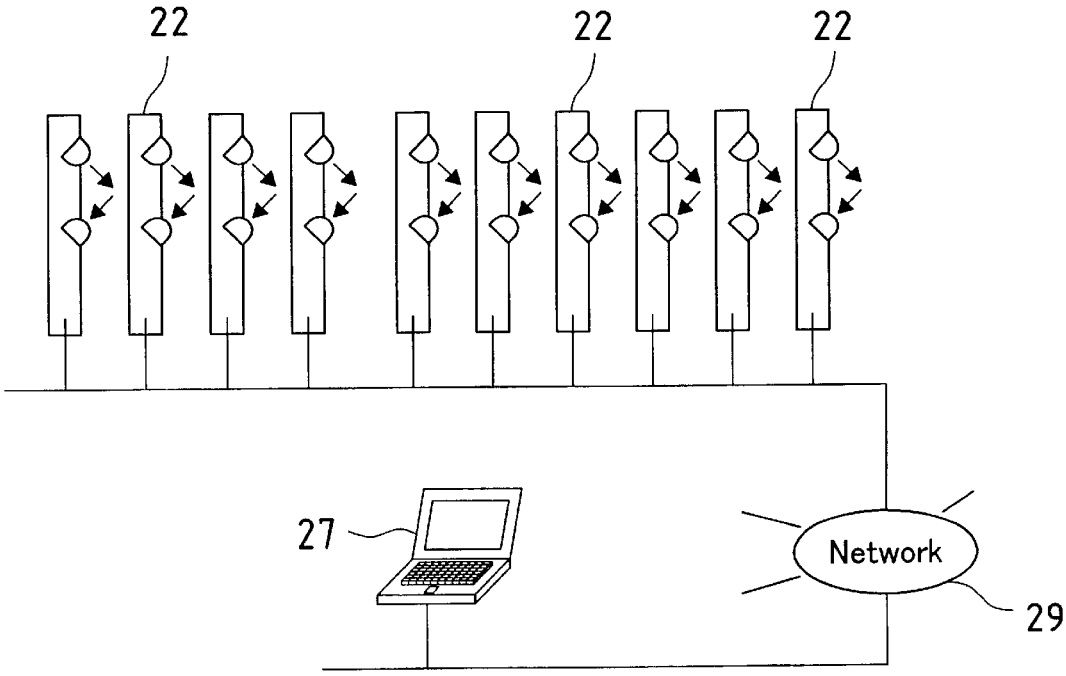
FIG. 8 schematically shows a network applied to an embodiment of the road traffic weather-monitoring system according to the present invention.

According to the present embodiment of the road traffic weather-monitoring system, the sensor units 22 can be installed in a wide area, and a computer can be utilized to collect and comprehensively manage the measurement data and the weather data through a network. FIG. 8 schematically shows the network in this system. In this system, the measurement data and weather data obtained from the sensor units 22 . . . 22 are supplied via a network 29 to an information processor 27. The information processor 27 analyzes these data and predicts any possible danger. The information on the predicted danger is presented to drivers in various modes by means of the above-mentioned road installations.

Figure 9:
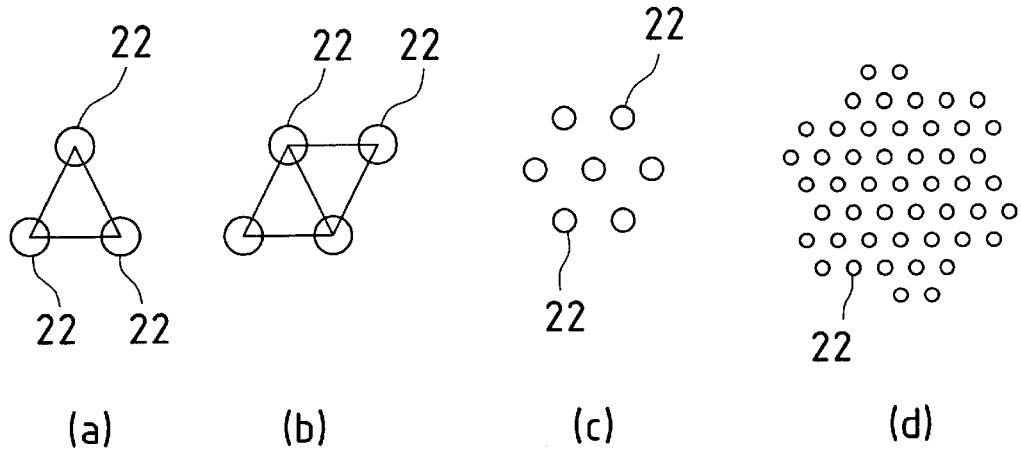
FIG. 9 shows layout examples of the sensor units applied to an embodiment of the road traffic weather-monitoring system according to the present invention.

In this embodiment of the road traffic weather-monitoring system, a plurality of sensor units 22 can be arranged in the manner shown in FIG. 9. As a result, it is possible to collect weather data from a wide range of area and to provide information with the passage of time. FIG. 9 shows layout examples of the sensor units for this arrangement.

In this arrangement, the sensor units 22 are disposed in the form of a triangle, as shown in FIG. 9(*a*), in such a manner that their detection area covers the driving environment area on the road. In order to simplify the positioning of the sensor units 22, the triangular pattern shown in FIG. 9(*a*) may incorporate another sensor unit 22, thereby presenting a quadrangular pattern made of two combined triangles as shown in FIG. 9(*b*). By multiplying these patterns, the sensor units 22 can be installed over a wide area, as illustrated in FIG. 9(*c*) or FIG. 9(*d*).

The interval of these sensor units 22 . . . 22 is 0 to 1000 meters, and usually 500 meters. It is suitable that the sensor units 22 are positioned, with the road taken as the center, along the middle or a side of the road. In practice, however, it is sufficient if the detection area of the sensor units 22 includes the driving environment area on the road, as described above. Desirably, they are positioned properly in consideration of obstructions and the difficulty of installation.

Figure 10:
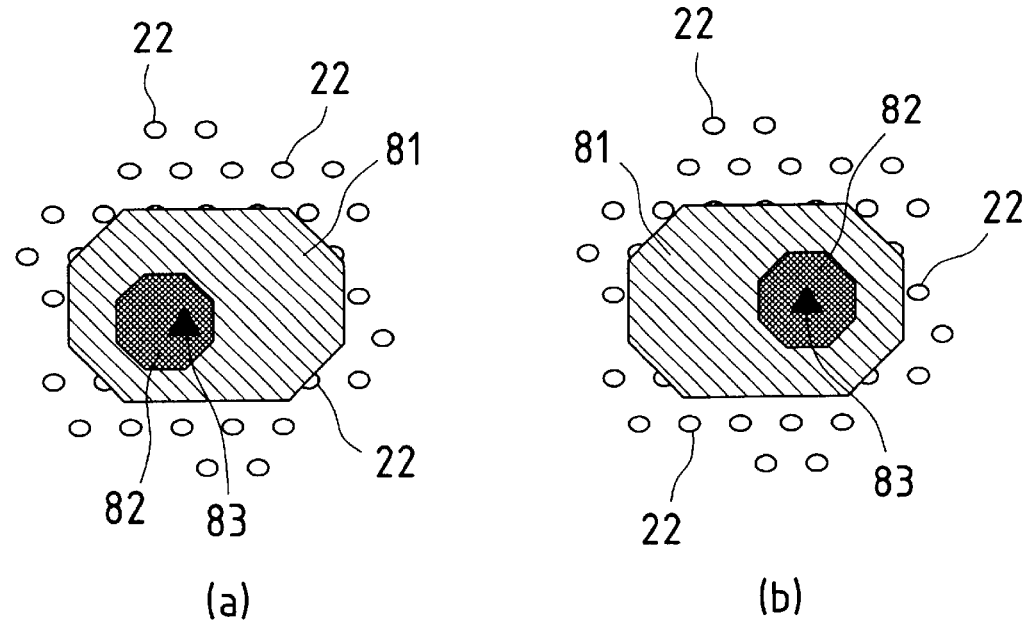
FIG. 10 represents fog rise situations in a particular area over time.

In this embodiment of the road traffic weather-monitoring system, where the sensor units 22 . . . 22 are arranged in the above manner, weather data in a particular area (e.g. foggy or snowy area) can be collected with the passage of time so as to give a grasp of the weather change in the area. Besides, any possible danger in the driving environment can be predicted by analyzing the weather data. FIG. 10 shows situations of fog development in a certain area over some time. The illustrations indicate the state shown in FIG. 10(*a*) has turned into the state shown in FIG. 10(*b*) with the passage of time. Both illustrations include shaded areas 81 where the visible distance is between 800 to 1000 meters, checked areas 82 where the visible distance is between 100 to 500 meters, and black areas 83 where the visible distance is 100 meter or less. Among them, a danger is predicted in the area 83 where the visible distance is particularly limited.

Such weather information and predictive information are provided to drivers in real time and in an easily recognizable display mode, by means of the above-mentioned road installations or the Internet. This helps the drivers to drive safely.

<Embodiments of the Self-luminous Road Sign System According to the Present Invention>

Figure 11:
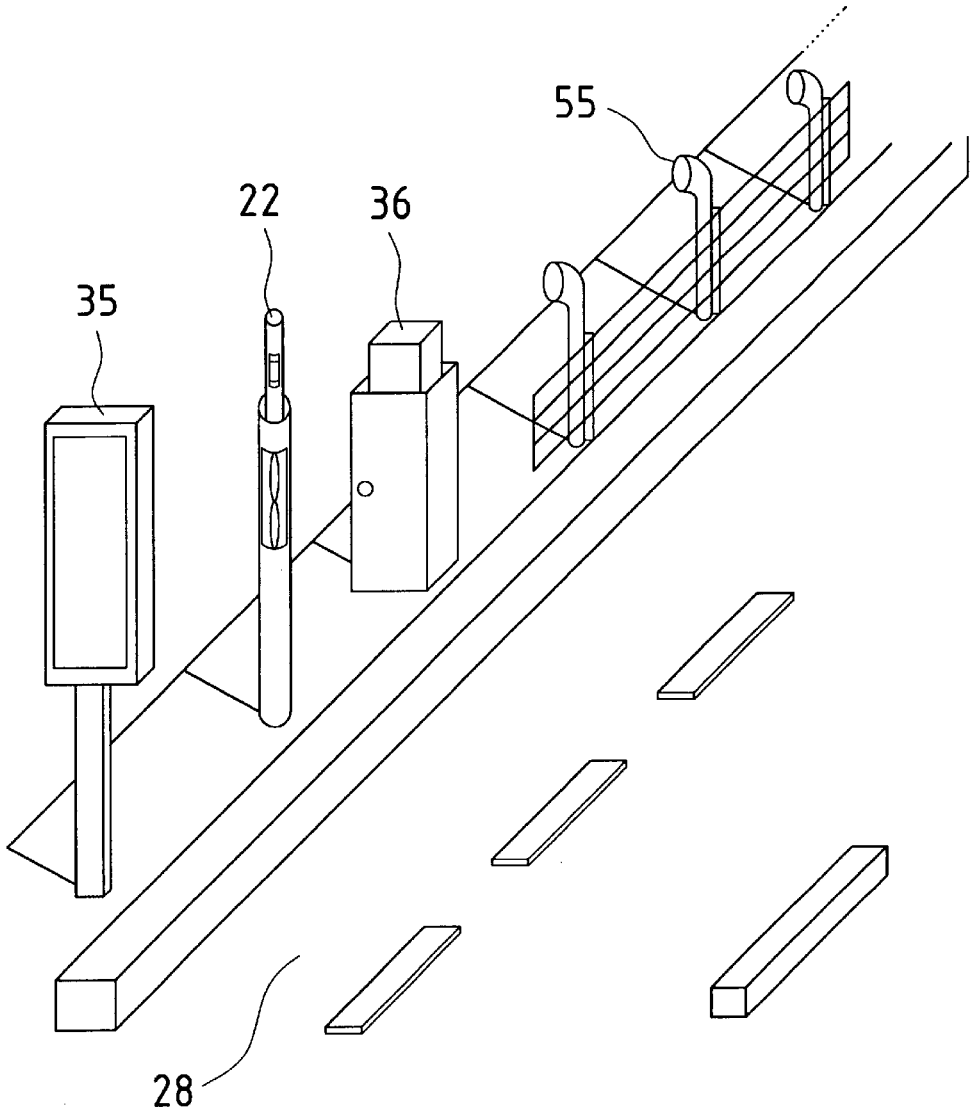
FIG. 11 is an illustrated explanation of an embodiment of the self-luminous road sign system according to the present invention.

FIG. 11 is an illustrated explanation of an embodiment of the self-luminous road sign system according to the present invention.

With regard to the self-luminous road sign system of this embodiment, a road installation is equipped with a self-luminous road sign part and endowed with various characteristics to be mentioned below.

The self-luminous road sign system of this embodiment includes a sensor unit 22, a self-luminous road information panel 35 and vision guidance signs 55 as the road installations, and a controller 36 for controlling these self-luminous road installations, with each element being installed along one side of the road 28. The sensor unit 22, the self-luminous road information panel 35, the vision guidance signs 55 and the controller 36 are connected by wired or radio communication means. Through this communication means, the controller 36 supplies the self-luminous road installations with the information that is controlled according to the measurement data and the weather data in the driving environment. Each of the self-luminous road installations such as the self-luminous road information panel 35 and the vision guidance signs 55 is equipped with an illuminant for self-luminous display. There is no particular limitation with regard to the illuminant, and use can be made of LED, laser, EL, UV lamp, optical fiber which illuminates by guiding a light from a light source, and the like.

Figure 12:
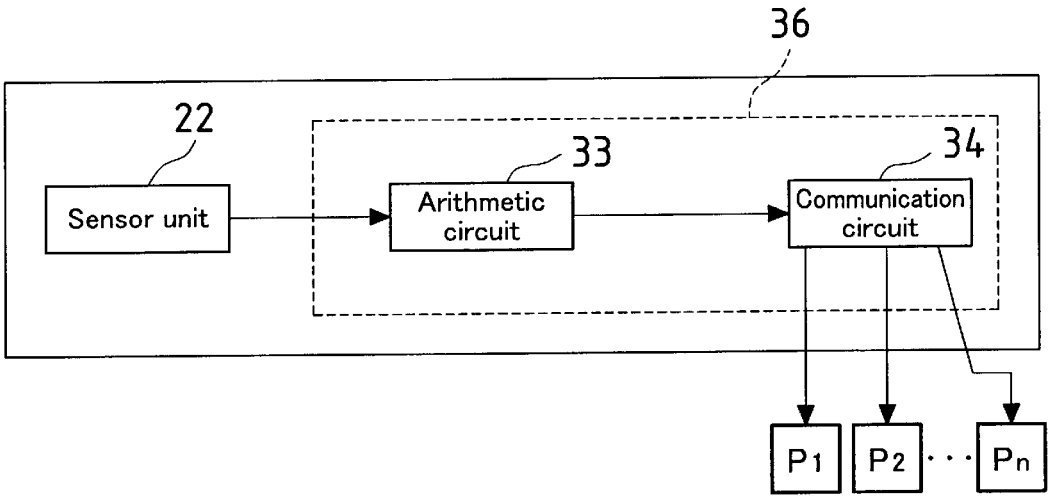
FIG. 12 is an explanatory block diagram of an embodiment of the self-luminous road sign system according to the present invention.

FIG. 12 is an explanatory block diagram of an embodiment of the self-luminous road sign system according to the present invention.

The controller 36, disposed in the vicinity of the sensor unit 22, comprises an arithmetic circuit 33 and a communication circuit 34. The arithmetic circuit 33 calculates the MOR and the like, based on the visibility data obtained by the sensor unit 22, and, in turn, produces control signals for controlling the lighting action of the illuminants P1, P2, . . . Pn, based on the calculation output and the weather data acquired by the sensor unit 22. The communication circuit 34 transmits control signals from the arithmetic circuit 33 to the illuminants P1, P2, . . . Pn.

Figure 13:
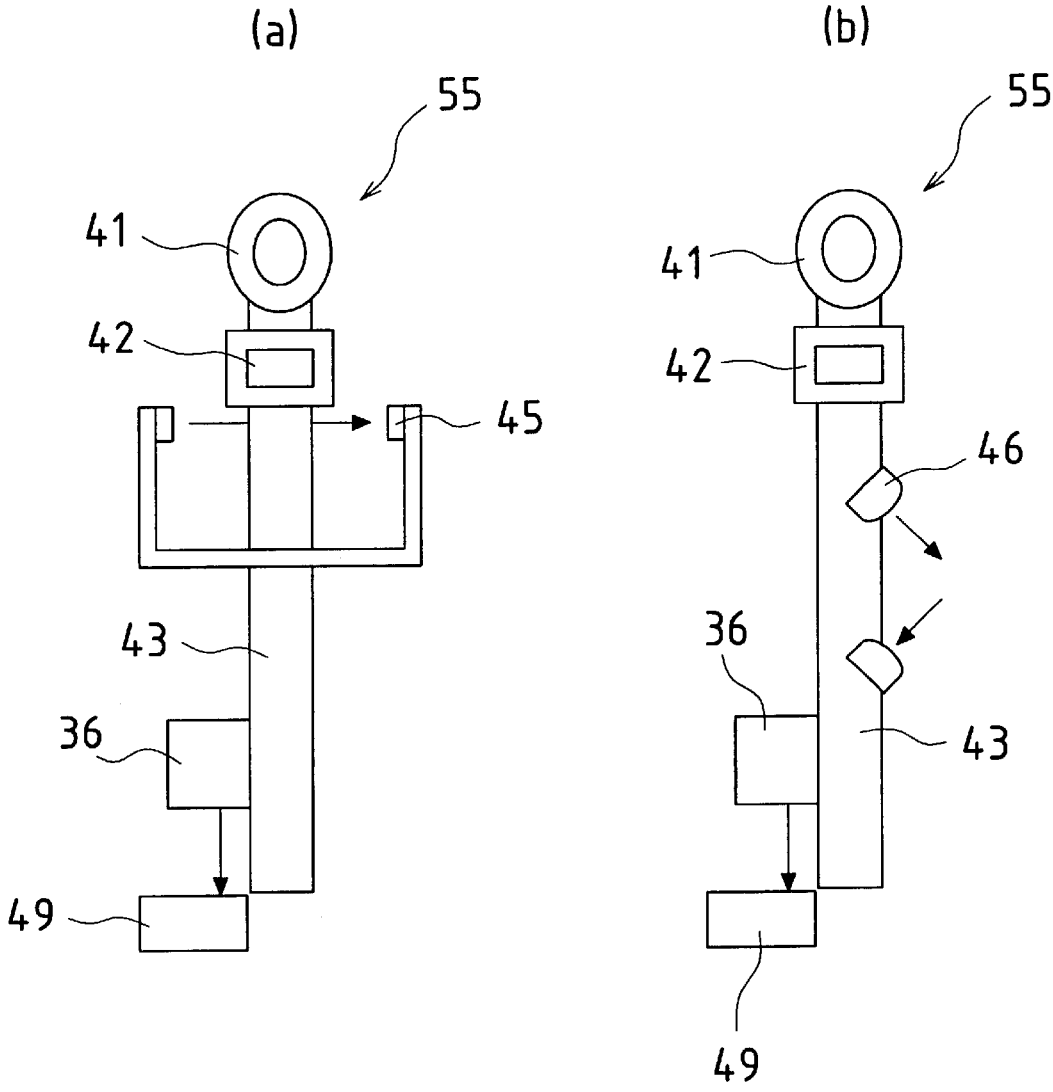
FIG. 13 shows front views of vision guidance signs each equipped with a visibility meter, in order to explain the examples in which the self-luminous road sign system according to the present invention is applied to each of such vision guidance signs.

This embodiment of the self-luminous road sign system may utilize a road installation unit in which the sensor unit and the self-luminous road installation are integrated. FIG. 13 shows front views of vision guidance signs each equipped with a visibility meter, in order to explain the examples using such vision guidance signs.

Referring first to FIG. 13(*a*), the vision guidance sign 55 uses a transmission visibility meter 45 as the visibility meter. At the top of a post 43, there are mounted a delineator 41 and an illumination device 42 each equipped with an LED or like illuminant. Similar to the above-mentioned delineator 25, the delineator 41 has its luminous brightness automatically controlled by the controller 36, depending on the weather conditions on the road 28, so as to make a contrast suitable to driver's eye and to provide proper vision guidance. The display form may be an arrow sign, a fletching sign, etc. The illumination device 42 calls attention of drivers, when the visible distance is 100 meters or less, by warning them of a dangerous visibility-limited situation. For example, use can be made of a high-brightness illuminant or a revolving light like a police car light. The transmission visibility meter 45 has a similar structure to the one used in the previous embodiment, and operates on the same principle as illustrated in FIG. 3. In this transmission visibility meter 45, the transmitter and the receiver may be aligned in the horizontal direction as in the case of this embodiment, or may be aligned in the vertical direction.

The vision guidance sign 55 shown in FIG. 13(*b*) is similar to the vision guidance sign 55 shown in FIG. 13(*a*), except that its visibility meter is a reflection visibility meter 46. The reflection visibility meter 46 is similar in structure to the one used in the previous embodiment, and works on the same principal as illustrated in FIG. 4. In the reflection visibility meter 46, the transmitter and the receiver may locate in a vertical relation as in this embodiment, but they may also be disposed in a horizontal relation.

With regard to the vision guidance sign 55 equipped with the transmission visibility meter 45 or the reflection visibility meter 46, measured data is sent to the above-mentioned controller 36. Based on the measured data, etc., the controller 36 controls the luminous brightness of the delineator 41 or the illumination device 42 by wire or radio communications, in the manner already described. The controller 36 also supplies a signal for controlling luminous brightness of another self-luminous road installation to a controller 49 in the other self-luminous road installation, thereby controlling the luminous brightness and display content with respect to the other self-luminous road installation.

Figure 14:
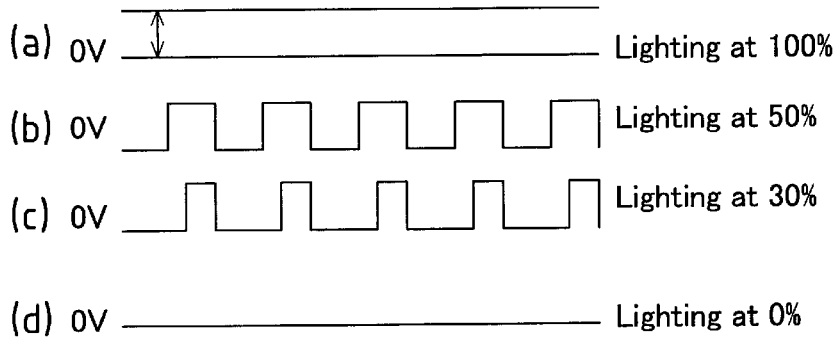
FIG. 14 is an illustrative explanation of a method for controlling the pulse duration of a pulse voltage which is applied on an illuminant mounted on the sign part of the road installation in the self-luminous road sign system according to the present invention.

The self-luminous road installation is controlled to the optimum luminous brightness, as described with reference to FIG. 5 and FIG. 6. The description on FIG. 5 and FIG. 6 is omitted here to avoid repetition. In the following description, the light adjustment method is detailed by means of specific examples. This light adjustment method controls the pulse duration of a pulse voltage to be applied to the illuminant, in such a manner as to give a prescribed luminous brightness. The usable pulses are high-speed pulses whose flashes cannot be perceived with eyes. By varying the duration of such pulses, it is possible to control the electric power consumed by the illuminant. FIG. 14 shows waveforms of voltages with different pulse durations. FIGS. 14(*a*), (*b*), (*c*) and (*d*) depict waveforms of pulse voltages which are applied for lighting at 100%, 50%, 30% and 0%, respectively. For example, in order to effect 50% lighting in view of these pulse voltage waveforms, every pulse may be adjusted to 50% or the total of pulses generated in a predetermined time may be adjusted to 50%. It should be understood that the waveforms of the pulse voltage are not limited to those shown in FIG. 14, but can be determined suitably.

Figure 15:
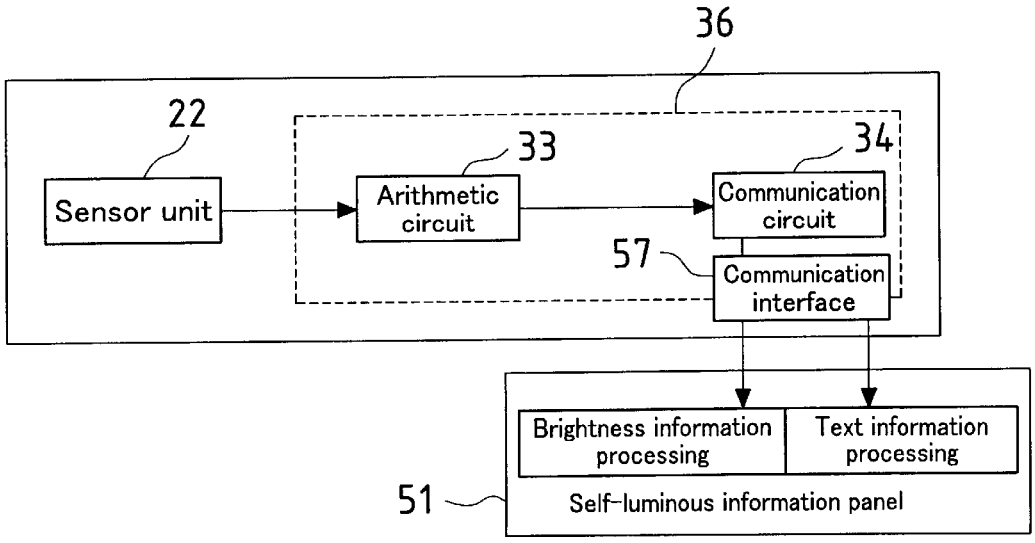
FIG. 15 is a block diagram showing another embodiment of the self-luminous road sign system according to the present invention.

Turning to FIG. 15, in another embodiment of the self-luminous road sign system of the present invention, the controller 36 is utilized to control a plurality of self-luminous information panels 51, similar to the structure shown in FIG. 12. Specifically, the construction shown in FIG. 15 has an arithmetic circuit 33 which controls, by arithmetic operation, the information display for the plurality of self-luminous information panels 51, the visible distance, the identification address of the sensor unit 22, and the like. The controller 36 also includes a communication circuit 34 through which output information from the arithmetic circuit 33 is transmitted via a communication interface 57 to each of the self-luminous information panels 51, by wire or radio communications. This construction is applicable, for instance, to centralized management for remote areas, serving as an interface for communicating with a computer in charge of the centralized management.

Figure 16:
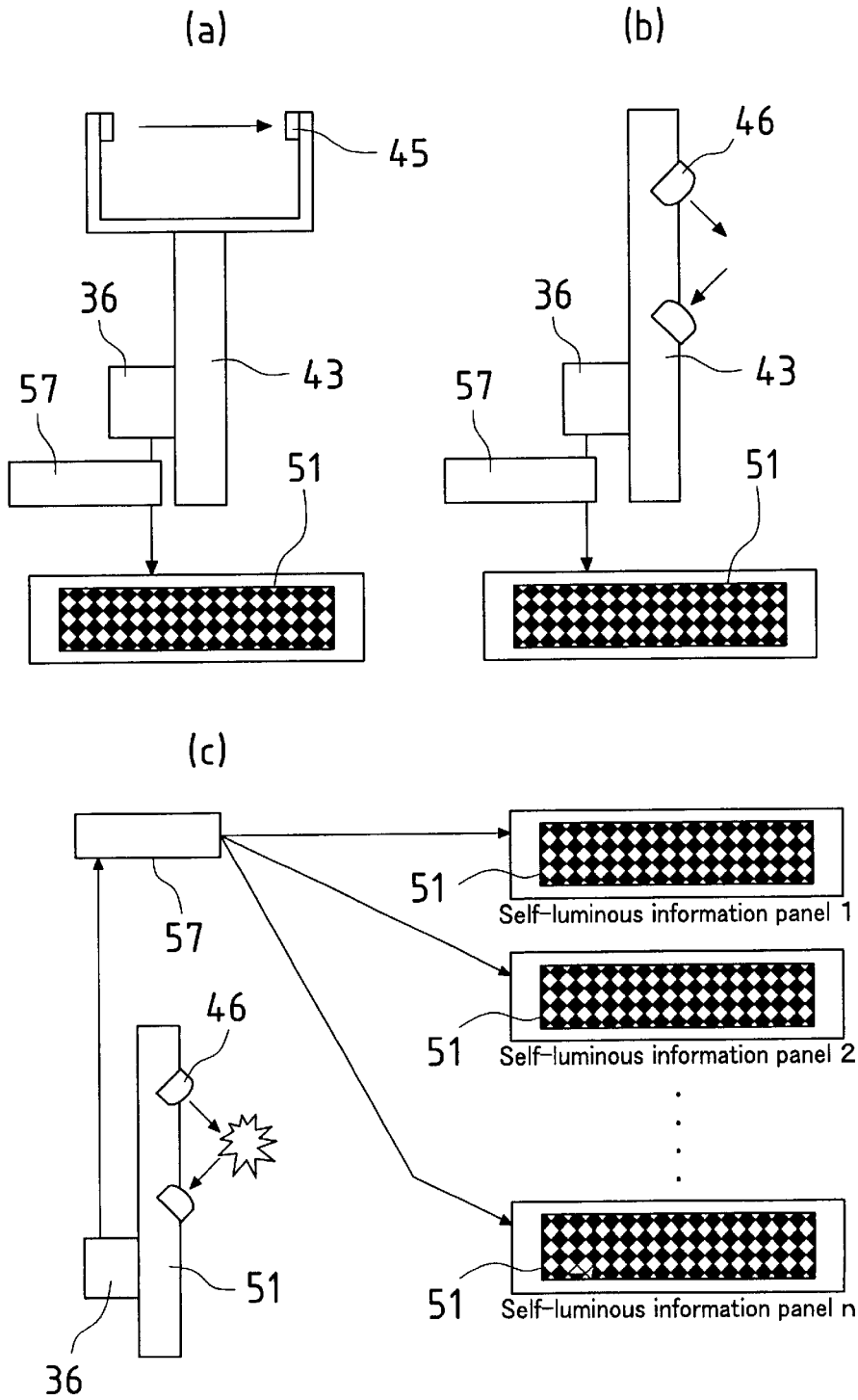
FIG. 16 shows front views of self-luminous information panels each equipped with a visibility meter, in order to explain the examples in which the self-luminous road sign system according to the present invention is applied to each of such self-luminous information panels.

FIG. 16 shows self-luminous information panels, each being applied to a vision guidance sign equipped with a visibility meter, similar to the case illustrated in FIG. 13. As the visibility meter, the self-luminous information panel in FIG. 16(*a*) employs a transmission visibility meter 45, and the self-luminous information panel in FIG. 16(*b*) has a reflection visibility meter 46.

Now, referring to FIG. 16(*c*), the operation using the reflection visibility meter 46 is described on the whole.

The reflection visibility meter 46 constantly measures the visibility. Based on the measured data, the controller 36 calculates the visible distance, converts the visibility information into the luminous brightness or display information, and send the ID address of the visibility meter and the visibility information to the control circuit or the interface 57.

If there is a host computer (not shown) in a remote place, the communication interface 57 sends the display information to the host computer, which in turn transmits the information to each of the self-luminous information panels 51. If no host computer is provided, the communication interface 57 transmits the display information to each of the self-luminous information panels 51.

Figure 17:
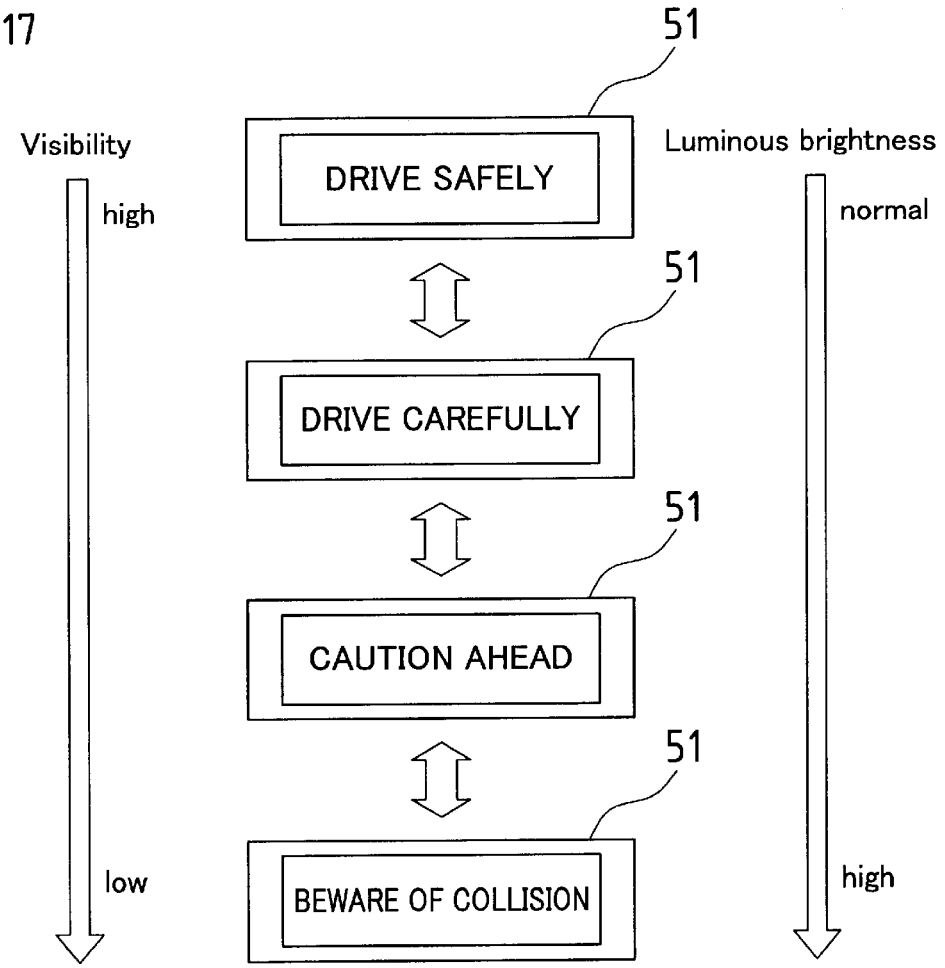
FIG. 17 is an explanatory illustration of an information display example in which the self-luminous road sign system according to the present invention is applied to a self-luminous information panel.

On receipt of the visibility information which relates to the assigned area, the self-luminous information panel 51 decides to output the information. In this case, as illustrated in FIG. 17, the luminous brightness is controlled to the best degree based on the visibility information, while there appears appropriate display information which is selected from "DRIVE SAFELY", "DRIVE CAREFULLY", "CAUTION AHEAD", "BEWARE OF COLLISION". On the other hand, if the information relates to the outside of the assigned area, there appears an indication with respect to the area of limited visibility and the degree of visibility limitation, or prescribed information. In this case, too, the luminous brightness is controlled by altering the pulse duration of high-speed pulses, as illustrated in FIG. 14.

Furthermore, the self-luminous road sign system according to this embodiment may utilize a host computer in the above-mentioned manner. Such a system can be combined with the road traffic weather-monitoring system of the present invention which utilizes a computer for centralized management.

Inudustrial Applicability

The road traffic weather-monitoring system of the present invention is advantageous in precisely grasping the weather conditions in a wide area and making contribution as an information source for automatic operation of an extensive road information system. Besides, this system is excellent in providing real-time weather conditions to drivers, thereby preventing the occurrence of accidents. This system is further expected to figure out the mechanism of road traffic accident occurrences and to enhance the precision of analyses by accumulating basic data on the driving environment.

In addition, the self-luminous road sign system controls the self-luminous road installation in terms of luminous brightness or information display, based on the optimum luminous brightness and depending on the visibility information. Thus, the system is useful in improving visual perceptibility of the characters or signs which represent display information and encouraging drivers to drive safely.

What is claimed is:

1. A self-luminous road sign system which comprises a sensor unit for detecting weather conditions, a self-luminous road installation which includes a sign part equipped with an illuminant and, a control part which controls luminous brightness or information display of the sign part based on weather information detected by the sensor unit, wherein the sensor unit is equipped with a visibility meter and an illuminance meter, and the control part calculates an optimum luminous brightness which provides a predetermined contrast in a driving environment, based on a road background brightness that is previously obtained by the illuminance meter, and the control part controls luminous brightness or information display of the sign part, based on the optimum luminous brightness and depending on visibility information that is outputted from the visibility meter.

2. A self-luminous road sign system according to claim 1, wherein the sign part is constituted with a vision guidance sign.

3. A self-luminous road sign system according to claim 2, wherein the sensor unit and the self-luminous road installation are integrated as a road installation unit.

4. A self-luminous road sign system according to claim 3, wherein the road installation unit controls, by wire or radio communications, luminous brightness or information display of the sign parts in the own road installation unit and one or more other road installations.

5. A self-luminous road sign system according to claim 1, wherein the sign part is constituted with a self-luminous information panel.

6. A self-luminous road sign system according to claim 5, wherein the sensor unit and the self-luminous road installation are integrated as a road installation unit.

7. A self-luminous road sign system according to claim 6, wherein the road installation unit controls, by wire or radio communications, luminous brightness or information display of the sign parts in the own road installation unit and one or more other road installations.

8. A self-luminous road sign system according to claim 1, wherein the sensor unit and the self-luminous road installation are integrated as a road installation unit.

9. A self-luminous road sign system according to claim 8, wherein the road installation unit controls, by wire or radio communications, luminous brightness or information display of the sign parts in the own road installation unit and one or more other road installations.

10. A self-luminous road sign system according to claim 1, wherein the control part controls luminous brightness of the sign part in the self-luminous road installation to give a prescribed luminous brightness, by adjusting a pulse duration of a pulse voltage which is applied to the illuminant.

11. A self-luminous road sign system according to claim 1, wherein the sensor unit includes a visibility meter.

12. A self-luminous road sign system according to claim 11, wherein the visibility meter includes at least one of a transmission visibility meter and a reflection visibility meter.

13. A self-luminous road sign system according to claim 11, wherein the sensor unit includes an illuminance meter.

14. A self-luminous road sign system according to claim 12, wherein the sensor unit includes an anemovane.

15. A self-luminous road sign system according to claim 14, wherein the sensor unit includes a thermometer.

16. A self-luminous road sign system which comprises a sensor unit for detecting weather conditions including visibility, a self-luminous road installation which includes a sign part equipped with an illuminant and, a control part which controls luminous brightness of the sign part based on the visibility detected by the sensor unit, wherein the sensor unit senses meteorological optical range and ambient illuminance and the control part automatically controls the self-luminous road installation to provide a suitable contrast to a human's eyes depending upon the visibility.

* * * * *